US008870457B2

(12) United States Patent
Deck et al.

(10) Patent No.: US 8,870,457 B2
(45) Date of Patent: Oct. 28, 2014

(54) STORAGE POCKET WITH ATTACHMENT RING AND LOOP FOR FOLDABLE SHOPPING BAGS AND OTHER ARTICLES

(76) Inventors: Mary Jane Deck, Naples, FL (US); Daniel Gatto, Brooklyn, NY (US)

( * ) Notice: Subject to any disclaimer, the term of this patent is extended or adjusted under 35 U.S.C. 154(b) by 411 days.

(21) Appl. No.: 13/031,664

(22) Filed: Feb. 22, 2011

(65) Prior Publication Data

US 2011/0142374 A1 Jun. 16, 2011

Related U.S. Application Data

(63) Continuation-in-part of application No. 12/174,847, filed on Jul. 17, 2008, now abandoned.

(51) Int. Cl.

| | |
|---|---|
| ***B65D 30/00*** | (2006.01) |
| ***B65D 33/06*** | (2006.01) |
| ***B65D 33/14*** | (2006.01) |
| ***A45C 3/04*** | (2006.01) |
| *A45C 7/00* | (2006.01) |

(52) U.S. Cl.
CPC *A45C 3/04* (2013.01); *A45C 7/0077* (2013.01)
USPC ..... 383/2; 383/4; 383/6; 383/22; 383/37

(58) Field of Classification Search
USPC ..... 224/575, 577, 581–583, 585, 586, 616, 224/254, 255, 269; 206/38, 38.1, 37, 37.1; 383/4, 15, 22, 24, 37; 150/104, 113, 150/131
See application file for complete search history.

(56) References Cited

U.S. PATENT DOCUMENTS

| | | | | |
|---|---|---|---|---|
| 2,532,778 | A | 12/1950 | Mintzes | |
| 4,085,873 | A | 4/1978 | Schweitzer | |
| 4,580,667 | A * | 4/1986 | Herwood | 190/110 |
| 5,009,516 | A | 4/1991 | Geeck | |
| 5,131,513 | A | 7/1992 | Gossage | |
| 5,152,612 | A | 10/1992 | Shoemaker | |
| 5,251,743 | A * | 10/1993 | Pulido et al. | 206/38.1 |
| 5,399,020 | A | 3/1995 | Cheng | |
| D358,024 | S | 5/1995 | Wilson | |
| 5,472,280 | A | 12/1995 | Rittmaster | |
| 5,564,125 | A * | 10/1996 | Waldman et al. | 2/93 |
| D383,903 | S | 9/1997 | Kopel | |
| 5,787,504 | A * | 8/1998 | Wu | 2/93 |
| 5,927,489 | A * | 7/1999 | Carswell | 206/315.1 |
| 6,224,258 | B1 * | 5/2001 | Dodson | 383/9 |
| 6,435,340 | B1 * | 8/2002 | Bowes, Jr. | 206/37.8 |
| 6,516,544 | B1 * | 2/2003 | Matisz et al. | 37/231 |
| 8,376,102 | B2 * | 2/2013 | Ritschel | 190/108 |
| 2007/0108240 | A1 | 5/2007 | Berger | |
| 2008/0232720 | A1 * | 9/2008 | Karagiannis | 383/22 |
| 2010/0147716 | A1 * | 6/2010 | Jones | 206/320 |

* cited by examiner

*Primary Examiner* — Jes F Pascua
*Assistant Examiner* — Nina Attel
(74) *Attorney, Agent, or Firm* — Livingston Loeffler, PA; Edward M. Livingston, Esq.; Bryan L. Loeffler, Esq.

(57) ABSTRACT

A storage pocket (9) having a front panel (19), a rear panel (20), an inner surface (10), an outer surface (11), an upper edge (12), a lower edge (13) and side edges (22). A pliable attachment ring (14) extends through two apertures (15) located along the lower edge of the storage pocket. An opening (21) located along the upper edge allows access to the inner surface of the storage pocket. A loop (16) located on the inner surface may be used in conjunction with the attachment ring to attach multiple storage pockets together while storing articles. The storage pocket may be integral to an article, such as a foldable shopping bag (1), poncho, article of clothing, etc, attached to an existing article, or used as a separate storage device.

2 Claims, 3 Drawing Sheets

STORAGE POCKET WITH ATTACHMENT RING AND LOOP FOR FOLDABLE SHOPPING BAGS AND OTHER ARTICLES

CROSS REFERENCE TO RELATED APPLICATION

This is a continuation-in-part application of Ser. No. 12/174,847 filed on Jul. 17, 2008 now abandoned. The patent application identified above is incorporated herein by reference in its entirety to provide continuity of disclosure.

BACKGROUND OF THE INVENTION

This invention relates to storage devices and carrying systems for articles, such as reusable foldable shopping bags an more specifically to articles that may be collapsed and folded into a storage pocket located on the external surface of the article and then attached to other storage pockets using attachment rings and loops that are sewn into the storage pockets.

With the ever-increasing need and desire to be environmentally-friendly, grocery stores, department stores and the like are now offering canvas or other fabric bags for use in lieu of paper or plastic bags. However, oftentimes customers simply forget to bring the reusable bags with them to the store or decide to leave the reusable bags at home, opting to use the more convenient paper or plastic bags provided by the store. This is due to the fact that reusable bags are often too small for practical use and/or inconvenient to store and carry, especially when multiple bags are needed.

This problem also occurs with other foldable articles, such as ponchos, wind breakers, an article of clothing, pants, shirts, etc., that need to be compactly stored and easily carried for convenience.

Therefore, a need exists for a carrying system that will allow a user to easily store and/or carry multiple shopping bags or other articles, such as clothing, ponchos, windbreakers, etc., while not in use.

The relevant prior art includes the following references:

| Pat. No. (U.S. unless stated otherwise) | Inventor | Issue/Publication Date |
|---|---|---|
| 2007/0108240 | Berger | May 17, 2007 |
| D383,903 | Kopel | Sep. 23, 1997 |
| 5,472,280 | Rittmaster | Dec. 05, 1995 |
| D358,024 | Wilson | May 09, 1995 |
| 5,399,020 | Cheng | Mar. 21, 1995 |
| 5,152,612 | Shoemaker | Oct. 06, 1992 |
| 5,131,513 | Gossage | Jul. 21, 1992 |
| 5,009,516 | Geeck | Apr. 23, 1991 |
| 4,085,873 | Schweitzer | Apr. 25, 1978 |
| 2,532,778 | Mintzes | Dec. 05, 1950 |

SUMMARY OF THE INVENTION

The primary objects of the present invention is to provide a storage pocket with attachment ring and loop that can be used on foldable shopping bags for storing the shopping bags while not in use.

Another object of the present invention is to provide a storage pocket with attachment ring and loop that can be used on foldable shopping bags that allows a user to link multiple foldable shopping bags to one another while in a stored position.

An even further object of the present invention is to provide a storage pocket with attachment ring and loop can be used on various articles, such as pants, shirts, ponchos, wind breakers and so forth.

The present invention accomplishes these and other objectives by providing a storage pocket having an an inner surface, an outer surface, an upper edge, a lower edge, a flap located along the upper edge and a loop located on the inner surface. A pliable attachment ring is sewn into the lower edge of the storage pocket so that half of the attachment ring is located inside the storage pocket and half of the attachment ring is located outside of the storage pocket. The storage pocket may be used on any foldable article, such as shirts, pants, ponchos, shopping bags, beach bags, etc. For example, the storage pocket may be used on a reusable foldable shopping bag having a body of a predetermined shape and handles. The storage pocket may be located on the external surface or inner surface of the body. The body and handles may be folded into the storage pocket for easy storage, thereby turning the storage pocket inside out. The attachment ring is preferably made of a pliable material, such as rubber, soft plastic, etc., to allow a user to squeeze the attachment ring of a first storage pocket and place it through the loop of a second storage pocket, thereby attaching two storage pockets together. Multiple storage pockets may be attached to one another to form a chain and or stack of storage pockets for easy storage and transportation. A user may also attach storage pockets having various contents together. For example, a user may attach a poncho that has been folded into a storage pocket to a pair of rain pants that have been folded into a storage pocket. The attachment ring also allows a user to hang and store the storage pocket and any contents on an object, such as a hook, shopping cart, etc., while in a folded position.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
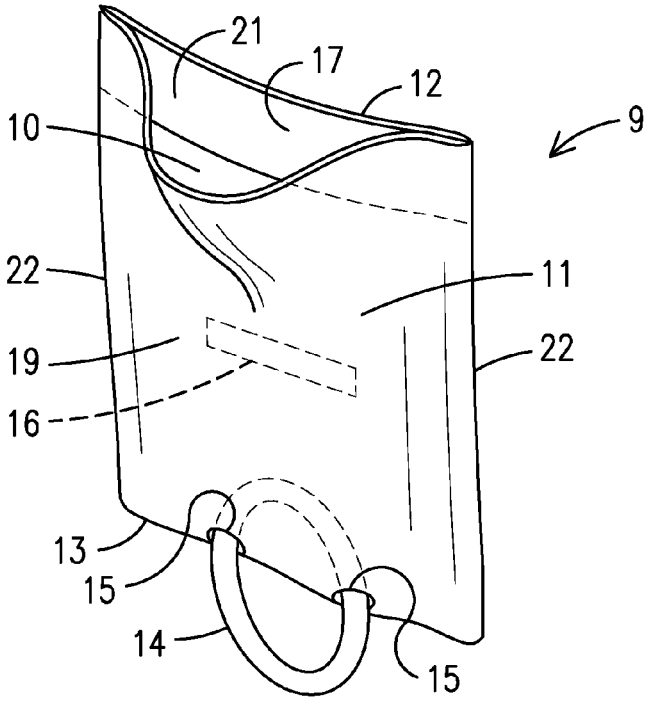
FIG. 1 is a perspective plan view of a storage pocket having an attachment ring and loop of the present invention.
Figure 5:
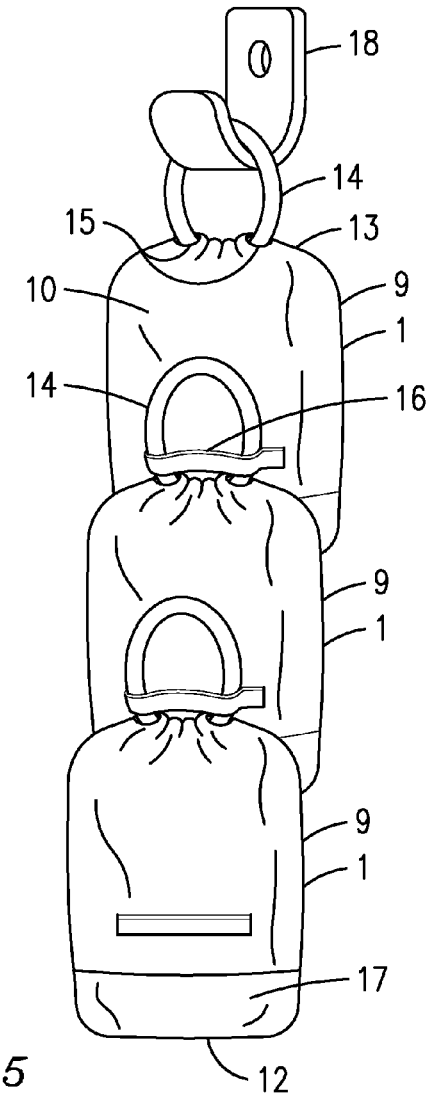
FIG. 5 is a view of multiple storage pockets of the present invention having folded shopping bags stored inside attached to each other to form a chain of storage pockets hanging from a hook.
Figure 6:
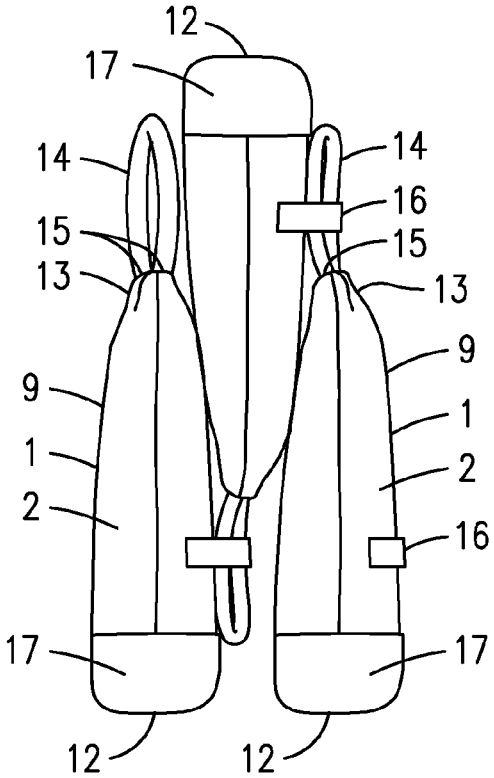
FIG. 6 is a view of multiple storage pockets of the present invention having folded shopping bags stored inside attached to each other to form a stack of storage pocket.
Figure 7:
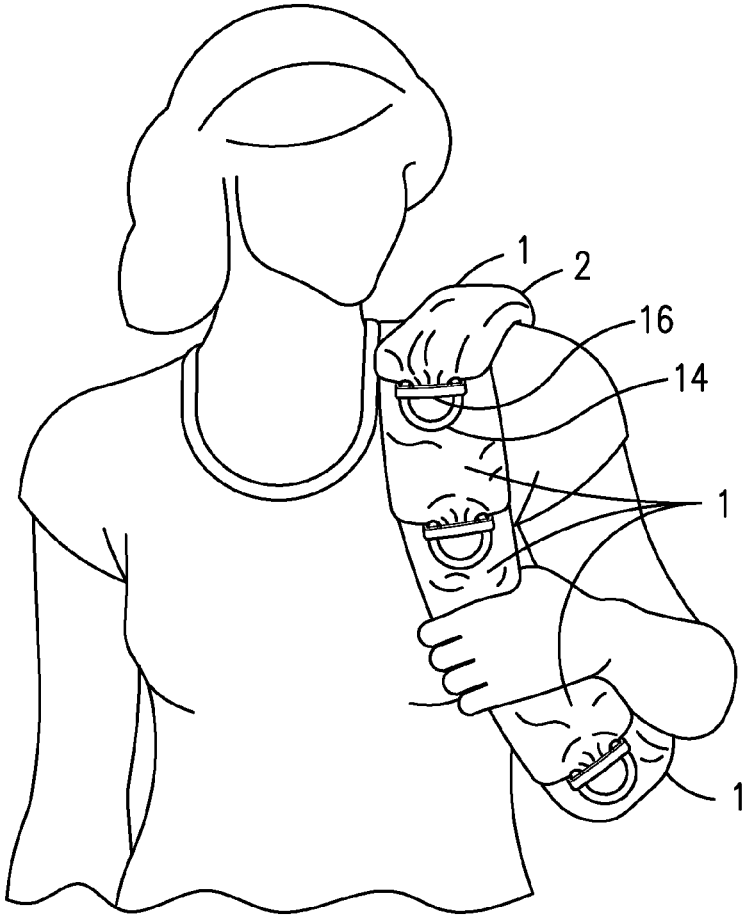
FIG. 7 is a view of multiple storage pockets of the present invention having folded shopping bags stored inside attached to each other to form a chain of storage pocket being carried over a user's shoulder.

For purposes of describing the preferred embodiment, the terminology used in reference to the numbered components in the drawings is as follows:

1. foldable shopping bag
2. body
3. bottom
4. front side
5. rear side
6. right side
7. left side
8. handle
9. storage pocket
10. inner surface
11. outer surface
12. upper edge
13. lower edge
14. attachment ring
15. aperture
16. loop
17. flap
18. hook
19. front panel
20. rear panel
21. opening
22. side edge With reference to FIG. 1, a perspective plan view of a storage pocket 9 having an attachment ring 14 and loop 16 of the present invention is shown. The storage pocket 9 comprises a front panel 19, a rear panel 20, an inner surface 10, an outer surface 11, an upper edge 12, a lower edge 13 and side edges 22. An attachment ring 14 extends through two apertures 15 located along the lower edge 13 of the storage pocket 9. The attachment ring 14 is preferably constructed out of a pliable material, such as rubber or soft plastic, to allow a user to squeeze the sides of the attachment ring 14 together. An opening 21 located along the upper edge 12 allows access to the inner surface 10 of the storage pocket 9. A flap 17 located along the upper edge 12 of the storage pocket 9 may be folded over the upper edge 12, thereby sealing the opening of the storage pocket 9 (as shown in FIG. 4). The loop 16, which is located on the inner surface 10, may be used in conjunction with the attachment ring 14 to attach multiple storage pockets 9 together (as shown in FIGS. 5, 6 and 7). The storage pocket 9 may be used to store a variety of articles, such as a foldable shopping bag (as shown in FIGS. 2-7), a poncho, clothing, etc. The storage pocket 9 may be integral to the article, attached to an existing article via an attachment means, such as sewing, adhesives, hook and loop fastener, etc., or used as a separate storage device.

Figure 2:
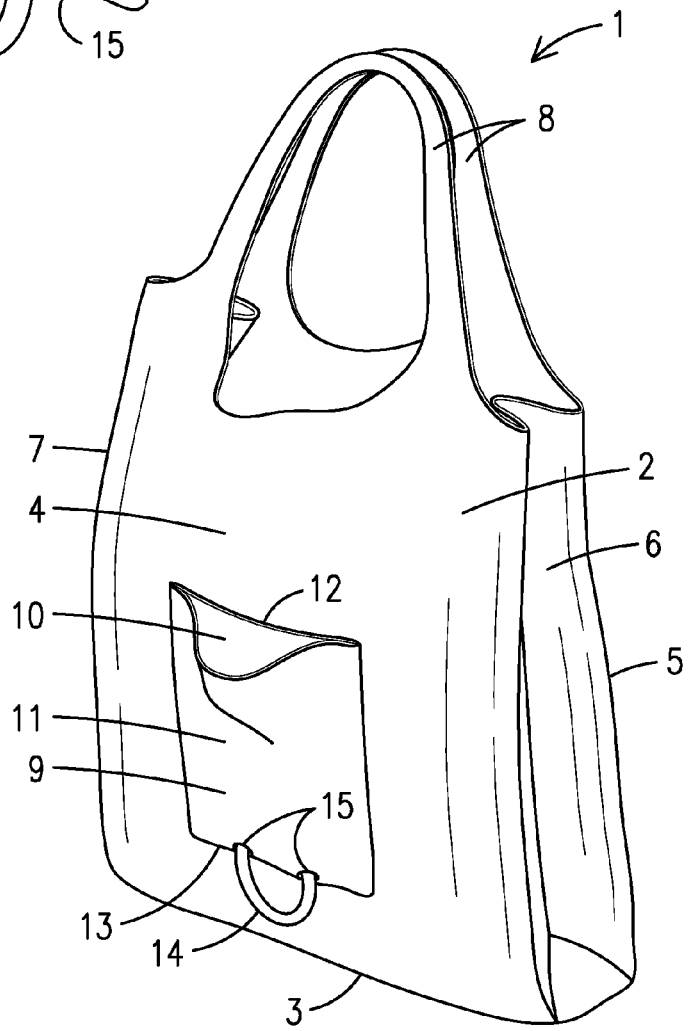
FIG. 2 is a perspective view of a storage pocket having an attachment ring and loop of the present invention located on a foldable shopping bag that is in an open position.

With reference to FIG. 2, a perspective view of a storage pocket 9 having an attachment ring 14 and loop 16 of the present invention located on a foldable shopping bag 1 that is in an open position is shown. The foldable shopping bag 1 comprises a body 2 having a bottom 3, a front side 4, a rear side 5, a right side 6 and a left side 7. Handles 8 used for carrying the foldable shopping bag 1 extend upward from the body 2 on the front side 4 and the rear side 5. The storage pocket 9 comprises a front panel 19, a rear panel 20, an inner surface 10, an outer surface 11, an upper edge 12 and a lower edge 13. An attachment ring 14 extends through two apertures 15 located along the lower edge 13 of the storage pocket 9. As shown here, the rear panel 20 of the storage pocket is created by the front side 4 of the foldable shopping bag 1.

With reference to FIG. 2, a perspective view of a storage pocket 9 having an attachment ring 14 and loop 6 of the present invention located on a foldable shopping bag 1 that is being folded into the storage pocket 9 is shown. When not in use, the foldable shopping bag 1 may be placed into the storage pocket 9 by pulling the attachment ring 14 up through the storage pocket 9, thereby turning the storage pocket 9 inside-out so that the inner surface 10 is on the exterior of the storage pocket 9. The body 2 of the foldable shopping bag 2 may then be folded into the storage pocket 9.

Figure 3:
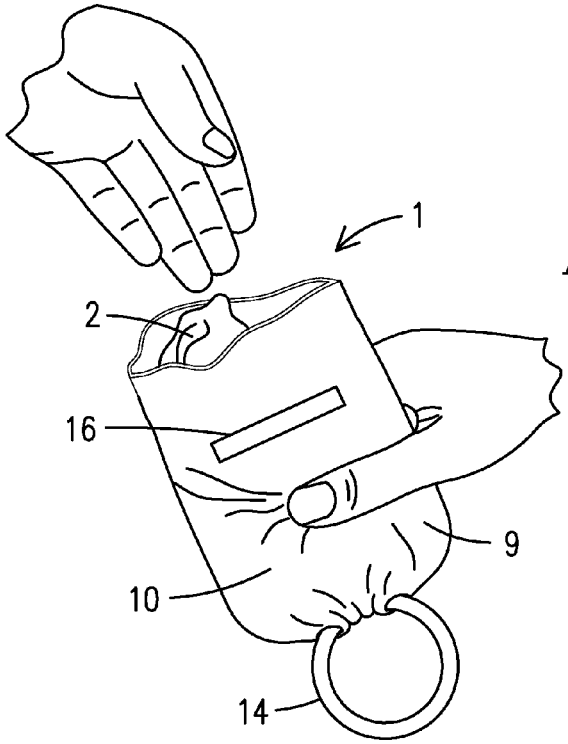
FIG. 3 is a perspective view of a storage pocket having an attachment ring and loop of the present invention located on a foldable shopping bag that is being folded into the storage pocket.
Figure 4:
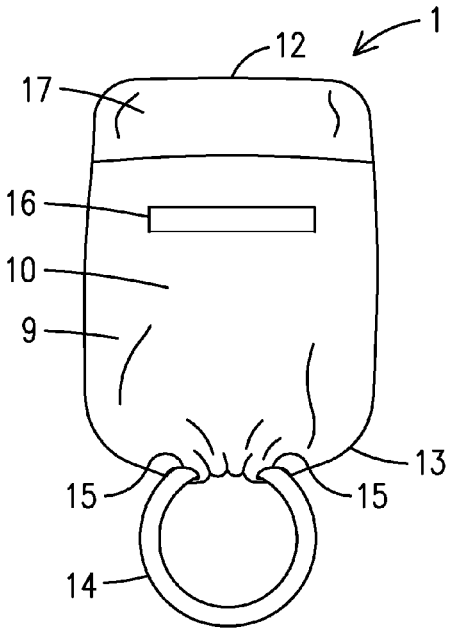
FIG. 4 is a front view of a storage pocket having an attachment ring and loop of the present invention located on a foldable shopping bag that is in a folded position and stored inside the storage pocket.

With reference to FIGS. 3 and 4, a perspective view and a front view, respectively of a storage pocket 9 having an attachment ring 14 and loop 6 of the present invention located on a foldable shopping bag that is in a folded position and stored inside the storage pocket 9 is shown. The storage pocket 9 has been turned inside-out so that the inner surface 10 is on the exterior of the storage pocket 9. The storage pocket 9 is storing the body 2 of the foldable shopping bag 1. An attachment ring 14 extends through two apertures 15 located along the lower edge 13 of the storage pocket 9. A loop 16 is located on the inner surface 10 of the storage pocket 9. The loop 16 may be used in conjunction with the attachment ring 14 to attach multiple foldable shopping bags 1 together (as shown in FIGS. 5, 6 and 7). A flap 17 located along the upper edge 12 of the storage pocket 9 may be folded over the upper edge 12, thereby sealing the body 2 of the foldable shopping bag 1 inside the storage pocket 9.

With reference to FIGS. 5, 6 and 7, views of multiple storage pockets 9 of the present invention attached to each other to form a chain of storage bags 9 hanging from a hook 18, a stack of storage bags 9 and a chain of storage bags 9 carried over a user's shoulder, respectively, are shown. Each storage pocket 9 comprises an attachment ring 14 that extends through two apertures 15 located along the lower edge 13 of the storage pocket 9. Each storage pocket 9 has a loop 16 located on the inner surface 10. To attach two storage pockets 9 together, the attachment ring 14 of a first storage pocket 9 may squeezed together and placed through the loop 16 of a second storage pocket 9. The attachment ring 14 may also be used to attach a storage pocket 9 to other objects, such as hooks 18, shopping carts, etc. A flap 17 located along the upper edge 12 of the storage pocket 9 may be folded over the upper edge 12, thereby sealing the opening 21 of the storage pocket 9.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. A foldable shopping bag having a storage pocket with attachment ring and loop for attaching multiple foldable shopping bags of the present invention together when in folded positions within storage pockets of each respective foldable shopping bag, said foldable shopping bag comprising:

a foldable shopping bag comprising a body having a bottom, a front side, a rear side, a right side and a left side; and at least one handle connected to the body;

a storage pocket attached to said foldable shopping bag;

said storage pocket having side edges, a lower edge and an upper edge;

said storage pocket having an inner surface and an outer surface;

an opening located along an upper edge of said storage pocket allowing access to the inner surface of the storage pocket;

two apertures located proximate to the lower edge of the storage pocket;

a substantially circular-shaped attachment ring extending through each of said two apertures so that the attachment ring is partially located inside the storage pocket and partially located outside the storage pocket;

a loop located on the inner surface of the storage pocket;

said loop being parallel to said upper edge of the storage pocket;

said attachment ring is made of a pliable material that allows a user to squeeze the attachment ring in order to place the attachment ring through the loop of a second foldable shopping bag, thereby creating a plurality of attached storage pockets; and said attachment ring is a continuous piece of material.

2. The foldable shopping bag of claim 1 further comprising:

a flap located along the upper edge of said storage pocket.

* * * * *